US008730114B2

(12) United States Patent
Elliot et al.

(10) Patent No.: US 8,730,114 B2
(45) Date of Patent: May 20, 2014

(54) LOW-PROFILE MULTIPLE-BEAM LENS ANTENNA

(75) Inventors: Paul G. Elliot, Acton, MA (US); Kiersten C. Kerby Patel, Somerville, MA (US)

(73) Assignee: Mitre Corporation, McLean, VA (US)

( * ) Notice: Subject to any disclaimer, the term of this patent is extended or adjusted under 35 U.S.C. 154(b) by 447 days.

(21) Appl. No.: 13/150,677

(22) Filed: Jun. 1, 2011

(65) Prior Publication Data

US 2012/0139804 A1 Jun. 7, 2012

Related U.S. Application Data

(60) Provisional application No. 61/350,800, filed on Jun. 2, 2010.

(51) Int. Cl.
*H01Q 19/06* (2006.01)

(52) U.S. Cl.
USPC ..... 343/754; 343/895

(58) Field of Classification Search
USPC ..... 343/754, 895, 790, 846, 773
See application file for complete search history.

(56) References Cited

U.S. PATENT DOCUMENTS

| | | | | |
|---|---|---|---|---|
| 6,697,031 | B2 * | 2/2004 | Jocher | 343/895 |
| 7,180,466 | B2 * | 2/2007 | Kuroda | 343/846 |
| 2006/0109180 | A1 * | 5/2006 | Fukuda | 343/700 MS |

OTHER PUBLICATIONS

IEEE Transactions on Antennas and Propagation, Podilchak, S.K et al., "Surface-Wave Launchers for Beam Steering and Application to Planar Leaky-Wave Antennas", vol. 57, No. 2, pp. 355-363, Feb. 2009.

McGraw-Hill, Johnson, R.C., "Antenna Engineering Handbook", chapter 10, pp. 10-1-10-21, chapter 16, pp. 16-1-16-32, and chapter 37, pp. 37-1-37-40, 1984.

Peter Perigrinus Ltd., Rudge et.al., "The Handbook of Antenna Design", vol. 1 and vol. 2, chapter 10, pp. 835-837, 1986.

Van-Nostrand Reinhold, Lo and Lee, "Antenna Handbook", vol. 2, chapter 13, pp. 13-5-13-9, 1993.

Naval Research Laboratory, NRL Memorandum Report 6204, Stilwell, P.D. et. al., "Design, Test and Evaluation of a Pair of Bootlace Lenses", pp. 1-72, Jul. 6, 1988.

Artech House, Inc., Fujimoto and James, "Mobile Antenna Systems Handbook", section 3.3.2, pp. 127-128, section 3.3.3, pp. 128-140, Section 3.3.4, p. 140, section 7.4.4, pp. 527-532, and A6, pp. 590-591, 1994.

International Mobile Satellite Conference, Woo et. al., "Performance of a Family of Omni and Steered Antennas for Mobile Satellite Applications," pp. 540-546, Jun. 1990.

International Mobile Satellite Conference, Milne, R., "An Adaptive Array Antenna for Mobile Satellite Communications," pp. 529-532, Jun. 1990.

(Continued)

*Primary Examiner* — Thien M Le
(74) *Attorney, Agent, or Firm* — Proskauer Rose LLP

(57) ABSTRACT

An antenna is provided for transmitting and receiving electromagnetic energy. A circular-shaped lens is disposed within a volume that has a first surface, a second surface, and a center, has an axis of rotation that passes substantially through the first surface, the second surface and the center. A plurality of feed elements are positioned at a plurality of focal points of the circular-shaped lens along at least a portion of a circle which is centered substantially on the axis of rotation. The thickness of the antenna is ⅓ or less of the diameter of the antenna.

20 Claims, 4 Drawing Sheets

(56) References Cited

OTHER PUBLICATIONS

Satellite Communications, Argus, Inc. Gedney, R.T. and Gargione, F. "ACTS, New Services for Communications", pp. 48-54, Sep. 1994.
Antenna Applications Symposium, Elliot, Paul, "Octave Bandwidth Microwave Array Element", pp. 537-555, 1995.
IEEE Transactions on Antennas and Propagation, Lee, J.J. et. al. "Photonic Wideband Array Antennas", vol. 43, No. 9, pp. 966-982, Sep. 1995.
Rome Laboratory, Abbas, Greg L., "Optically Controlled SHF Satcom Array", Boeing Final Report. RL-TR-95-267, pp. 1-58, Dec. 1995.
Microwave Journal, Seeds, Alwyn "Optical Beamforming Techniques for Phased Array Antennas", pp. 74-83, Jul. 1992.
Antenna Applications Symposium, Naval Research Laboratory, Parent, Mark G., "A Survey of Optical Beamforming Techniques", pp. 249-271, 1995.
Antenna Applications Symposium, Antenna Laboratory, Department of Electrical and Computer Engineering, Shin, J. and Schaubert, D.H., "Toward a Better Understanding of Wideband Vivaldi Notch Antenna Arrays," pp. 556-585, 1995.
IEEE Antennas and Propagation Society Intl Symposium, Carl Pfeiffer and Anthony Grbic, "A 2D Broadband Printed Luneburg Lens Antenna", pp. 1-4, Jun. 2009.
IET Microwaves, Antennas & Propagation, L. Xue and V. Fusco, "Patch-fed Planar Dielectric Slab Waveguide Luneburg Lens", vol. 2, No. 2, pp. 109-114, Mar. 2008.
IEEE Transactions on Antennas and Propagation, D. Jackson and N. Alexopoulos, "Gain Enhancement Methods for Printed Circuit Antennas," vol. 33, No. 9, pp. 976-987, Sep. 1985.
IEEE Transactions on Antennas and Propagation, H. Yang and N. Alexopoulos, "Gain Enhancement Methods for Printed Circuit Antennas through Multiple Superstrates," vol. 35, No. 7, pp. 860-863, Jul. 1987.
IEEE Transactions on Antennas and Propagation, Tianxia Zhao, D.R. Jackson, J.T. Williams, H-Y.D. Yang, A.A. Oliner, "2-D Periodic Leaky-Wave Antennas-Part I: Metal Patch Design," vol. 53, No. 11, pp. 3505-3514, Nov. 2005.
IEEE Transactions on Antennas and Propagation, Tianxia Zhao; D.R. Jackson, J.T. Williams, "2-D Periodic Leaky-Wave Antennas-Part II: slot Design," vol. 53, No. 11, pp. 3515-3524, Nov. 2005.
IEEE Transactions on Antennas and Propagation, Tianxia Zhao et al.; "General Formulas for 2-D Leaky-Wave Antennas," vol. 53, No. 11, pp. 3525-3533, Nov. 2005.
IEEE Antennas and Propagation Magazine, John Sanford and Hal Schrank, "A Luneburg-Lens Update", vol. 37, No. 1, Feb. 1995.
IEEE Antennas and Propagation Symposium, N. Herscovici and Z. Sipus, "A Spherical Multibeam Antenna", vol. 3 pp. 693-696, Jun. 2003.

* cited by examiner

LOW-PROFILE MULTIPLE-BEAM LENS ANTENNA

CROSS REFERENCE TO RELATED APPLICATION

This application claims the benefit of and priority to U.S. Provisional Patent Application No. 61/350,800, filed Jun. 2, 2010, the entire disclosure of which is incorporated herein by reference.

FIELD OF THE INVENTION

The present invention relates to a low-profile multiple-beam antenna having a wide field of view.

BACKGROUND

Communication systems that include antennas can be deployed in a variety of ways. For example, atop cars, trucks, trains, recreational vehicles (RVs), boats, military vehicles such as High Mobility Multipurpose Wheeled Vehicles (HMMWV), commercial aircraft, unmanned aerial vehicles (e.g., Global Hawk), as part of satellites, or networks (e.g., commercial WIMAX, WIFI, or the Army's Warfighter Information Network-Tactical program). Many existing communications systems that operate at C, X, Ku, or Ka-bands use specific types of antennas, for example, reflector (dish) antennas, horn antennas, and/or fixed-beam antennas.

Reflector, horn and other large vertical aperture antennas can require a large bubble radome. When deployed, these antennas typically have a large height. A large height can be problematic where height is limited, such as tunnels, underpasses, under bridges, in parking garages, or driving under branches. In addition, increased height can increase fuel consumption for commercial and military vehicles and aircraft due to added wind resistance. A large height can also increase visibility of the antenna platform, which is problematic for some applications (e.g., military vehicles) where low visibility of the platform is desirable. A large height can also reduce the mission range due to air resistance. In addition to size limitations, reflector and horn antennas typically limit the number of simultaneous beams and links because they typically only radiate in one direction at a time. Narrow-beam antennas such as many reflector antennas can require accurate mechanical steering of the dish, which is slow and greatly reduces the ability to operate on-the-move for off-road vehicles in rough terrain.

Fixed beam antennas can have a lack of beam agility, resulting in loss of link when a platform the antenna is deployed upon rolls or turns. Phased array antennas can be extremely expensive, can have high weight cooling systems, can operate over a limited frequency bandwidth with a limited number of simultaneous beam directions, and can have difficulty forming a beam at very low elevation angles unless they include a large vertical aperture. Existing designs incorporating lenses also have many of the same limitations and problems as phased arrays, or are too large and heavy for practical use.

SUMMARY OF THE INVENTION

Advantages of the invention include an antenna having a low-profile (e.g., low-height) with coverage of the entire hemisphere (360 degrees of azimuth or elevation) or selected portions. Other advantages include beam agility, the possibility of the beam being a fan beam, true time delay beam forming, rapid switching between beams, production of a desired pattern, and coverage of microwave or millimeter wave frequencies over a wide bandwidth.

Another advantage of the invention is that the antenna can include a beamforming lens, feed elements, and a radiating aperture all in one.

Another advantage of the invention is that the antenna can track multiple objects or wireless communication nodes while the platform the antenna is deployed upon is moving. Other advantages include the antenna can be deployed on the bottom of an aircraft to look down for air-to-ground communications or for some radar applications and low cost.

Other advantages of the invention include a very low cost in comparison to a phased array antenna.

In one aspect, the invention features an antenna. The antenna includes a circular-shaped lens disposed within a volume that has a first surface, a second surface, and a center, the circular-shaped lens having an axis of rotation that passes substantially through the first surface, the second surface and the center. The antenna also includes a plurality of feed elements positioned at a plurality of focal points of the circular-shaped lens along at least a portion of a circle that is centered substantially on the axis of rotation. The antenna also includes a thickness of ⅓ or less of a diameter of the antenna.

In some embodiments, each feed element is positioned 180 degrees or substantially 180 degrees from a corresponding feed element of the plurality of feed elements. In some embodiments, one or more of the plurality of feed elements transmits electromagnetic energy to the circular-shaped lens and the circular-shaped lens collimates at least a portion of the transmitted electromagnetic energy.

In some embodiments, the antenna includes a switching element in electrical communication with the plurality of feeds, the switching element selects the one or more of the plurality of feed elements to transmit electromagnetic energy such that the transmitted electromagnetic energy has a maximum radiation in a desired direction. In some embodiments, the antenna includes a switching element in electrical communication with the plurality of feeds, and the switching element selects the one or more of the plurality of feed elements to receive electromagnetic energy from a desired direction.

In some embodiments, the circular-shaped lens receives electromagnetic energy and focuses at least a portion of the received electromagnetic energy to one or more of the plurality of feed elements. In some embodiments, one or more of the plurality of feed elements is in electrical communication with one or more transmission lines. In some embodiments, the plurality of feed elements are monocone antennas. In some embodiments, the monocone antennas are in electrical communication with transmission lines.

In some embodiments, the antenna transmits and receives electromagnetic waves having a frequency between 8.2 to 12.2 gigahertz. In some embodiments, at least a portion of the circular-shaped lens is a dielectric material.

In another aspect, the invention features a method of transmitting and receiving electromagnetic energy. The method involves selecting one or more dielectric materials and diameter for a circular-shaped lens having a center. The method also involves determining a number of plurality of feed elements positioned adjacent to the circular-shaped lens along at least a portion of a circle that is substantially centered on the center of the circular-shaped lens. The method also involves collimating or focusing electromagnetic energy transmitted or received by the circular-shaped lens based on at least one of the one or more dielectric materials, the diameter, and the number of plurality of feed elements.

In some embodiments, the method involves positioning each feed element is 180 degree or substantially 180 degrees from a corresponding feed element of the plurality of feed elements. In some embodiments, the method involves transmitting, by one or more of the plurality of feed elements, electromagnetic energy to the circular-shaped lens and collimating, by the circular-shaped lens, at least a portion of the transmitted electromagnetic energy to radiate in a desired direction.

In some embodiments, focusing electromagnetic waves received by the circular-shaped lens further comprises focusing the electromagnetic waves to one or more of the plurality of feed elements. In some embodiments, one or more of the plurality of feed elements are in electrical communication with one or more transmission lines.

In some embodiments, the method involves selecting the one or more of the plurality of feed elements to transmit electromagnetic energy such that the collimated portion of the transmitted electromagnetic signals has a maximum radiation in a desired direction. In some embodiments, the method involves selecting the one or more of the plurality of feed elements to receive electromagnetic energy such that the collimated portion of the received electromagnetic energy has a maximum reception from a desired direction.

In some embodiments, the plurality of feed elements are monocone antennas. In some embodiments, the monocone antennas are in electrical communication with transmission lines.

BRIEF DESCRIPTION OF THE DRAWINGS

The foregoing features of the invention will be more readily understood by reference to the following detailed description, taken with reference to the accompanying drawings, in which.

DETAILED DESCRIPTION OF ILLUSTRATIVE EMBODIMENTS

Figure 1B:
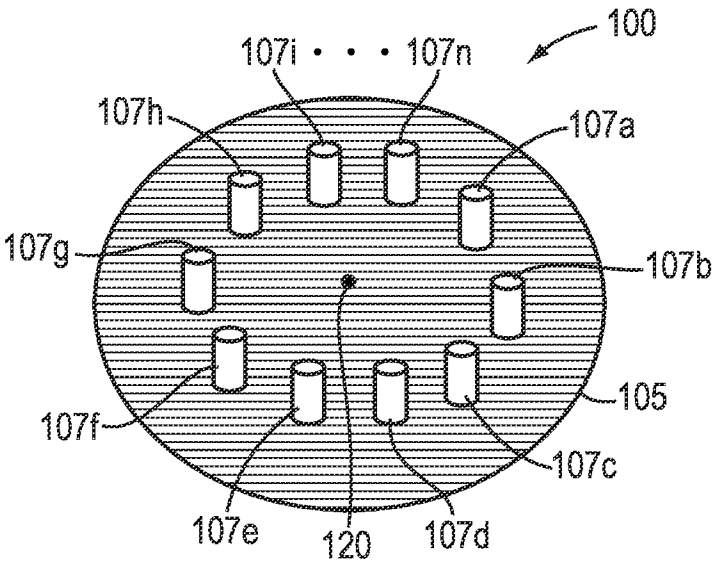
FIG. 1B is a diagram showing a bottom up view of the antenna of FIG. 1A.
Figure 1A:
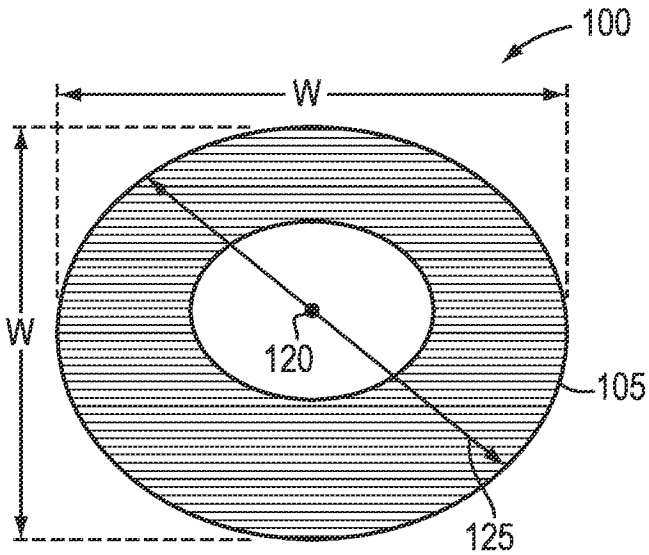
FIG. 1A is a diagram showing a top down view of an antenna according to an illustrative embodiment of the invention.
Figure 1C:
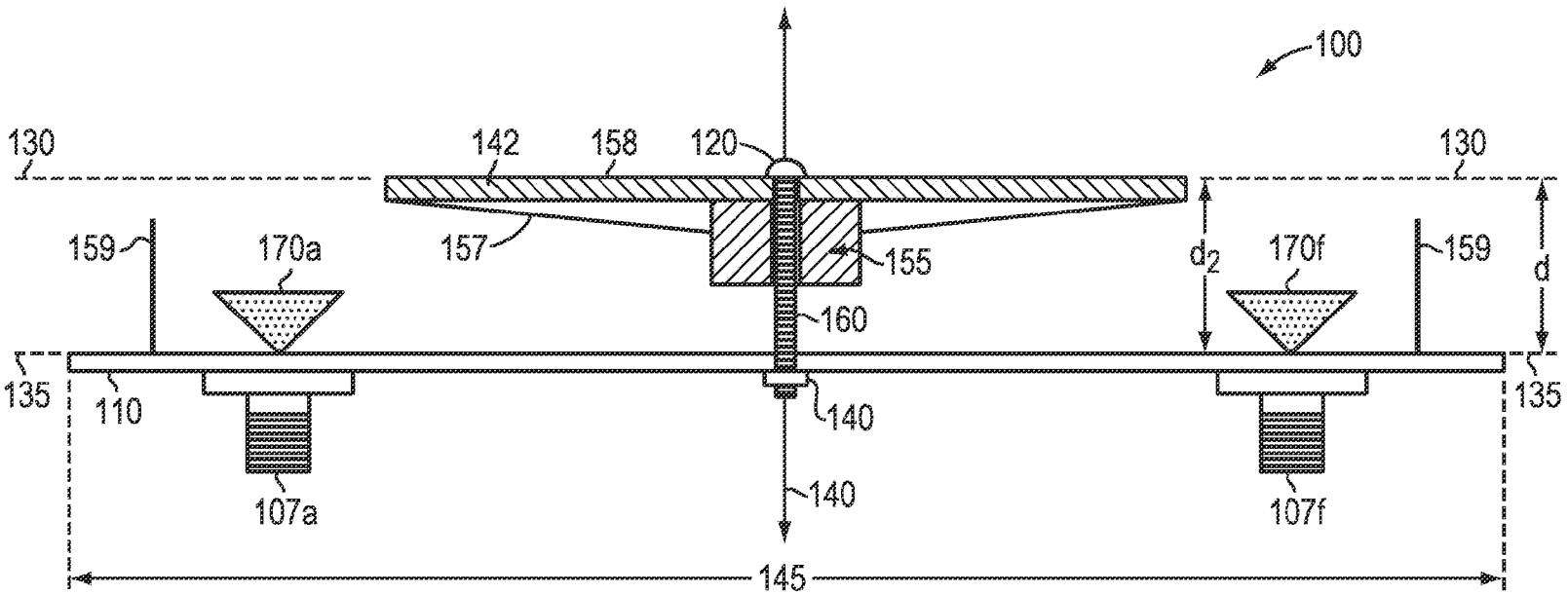
FIG. 1C is a diagram showing a cross-sectional view of the antenna of FIG. 1A.

FIG. 1A is a diagram showing a top down view of an antenna 100, according to an illustrative embodiment of the invention. FIG. 1B is a diagram showing a bottom up view of the antenna of FIG. 1A, according to an illustrative embodiment of the invention. FIG. 1C is a diagram showing a cross-sectional view of the antenna of FIG. 1A, according to an illustrative embodiment of the invention. The following discussion refers to elements shown in FIG. 1A, FIG. 1B, and FIG. 1C.

The antenna 100 includes a circular-shaped lens 105, a plurality of feed elements 170*a*, 170*f*, . . . , 170*n*, generally, 170. In some embodiments, the antenna 100 includes a mounting plate 110. In some embodiments, the antenna 100 weighs 259 grams.

The circular-shaped lens 105 includes a center 120, a diameter 125, and an axis of rotation 140. The circular-shaped lens 105 is disposed within a volume that includes a width w, a depth d, a first surface 130, and a second surface 135. The width w is substantially equal or equal to the diameter 125. The axis of rotation 140 extends from the first surface 130 to the second surface 135, positioned at the center 120. In some embodiments, the circular shaped lens 105 is a disc shape, having a first flat surface and a second flat surface. In these embodiments, first surface 130 is first flat surface of the cylinder and the second surface 135 is the second flat surface of the cylinder. In some embodiments, the circular-shaped lens 105 is a disc that has a first concentric grooved surface and a second flat surface. In these embodiments, the first surface 130 is a plane that is parallel to the first grooved surface positioned at the highest groove and the second surface 135 is the second flat surface. In some embodiments, the circular-shaped lens 105 has a first surface that is tapered from the center 120, and a second flat surface. In these embodiments, the first surface 130 is tapered from the center 120 and the second surface 135 is the second flat surface. In some embodiments, the circular-shaped lens 105 has a first surface that is tapered from the center 120, and a second surface that is tapered from the center 120. In these embodiments, the first surface 130 is tapered from the center 120 and the second surface 135 is the second surface tapered from the center 120. One of skill will appreciate that the circular-shaped lens 105 can have various substantially circularly symmetric first surface 130 an second surface 135 geometries and that the volume that the circular-shaped lens 105 is contained within can change as a function of the surface geometry.

In some embodiments, the diameter 125 is substantially equal to 13.3 cm diameter. In some embodiments, the depth d is substantially equal to 1.56 cm.

The circular-shaped lens 105 can include a first dielectric portion 142, a second dielectric portion 155, a reflective wall 159, and a dielectric bolt 160. The first dielectric portion 142 can include a bottom side 157 and a top side 158. The first dielectric portion 142 can be cone-shaped. The first dielectric portion 142 can be a disc. The first dielectric portion 142 can be a disc on top of or under a cone. The first dielectric portion 142 can be two cones. The first dielectric portion 142 can be any other circularly symmetric shape about the axis of rotation 140. The bottom side 157 can decrease in height or thickness or both from a center of the first dielectric portion 142 to an outermost edge of the first dielectric portion 142. In some embodiments, the top side 158 can decrease in thickness from a center of the first dielectric portion 142 to an outermost edge of the first dielectric portion 142.

The first dielectric portion 142 can include small circular conductive discs (not shown). In some embodiments, the small circular conductive discs are copper. In some embodiments, the small circular conductive discs are 0.42 cm wide. In some embodiments, the small circular conductive discs are located on the bottom side 157 of the first dielectric portion 142. In some embodiments, the small circular conductive discs are located in the first dielectric portion 142. In some embodiments, the first dielectric portion 142 is made of Duriod® 5870. In some embodiments, foam surrounds the circular shaped lens 105. In some embodiments, the foam is Rohacell foam.

The second dielectric portion 155 can be a cylindrical shape. The second dielectric portion 155 can be cone-shaped. The second dielectric portion 155 can be a disc. The second dielectric portion 155 can be a disc on top of or under a cone.

The second dielectric portion 155 can be two cones. The second dielectric portion 155 can be any circularly symmetric shape about the axis of rotation 140. In some embodiments, the second dielectric portion 155 is TMM10i material. In some embodiments, the second dielectric portion 155 has a dielectric constant substantially equal to 9.80.

The first dielectric portion 142 can be positioned adjacent to the second dielectric portion 155 such that a center of the first dielectric portion 142 and a center of the second dielectric portion 155 substantially align with the center 120. The bolt 160 can secure the first dielectric portion 142 to the second dielectric portion 155. In some embodiments, the bolt 160 can be nylon.

The reflective wall 159 can be metal, copper, aluminum, aluminum tape, brass, steel or any combination thereof. The reflective wall 159 can be positioned in a circle centered on the center 120 with a radius that is greater than distance from the center 120 to the plurality of feed elements 170. In some embodiments, the reflective wall 159 is attached to the mounting plate 110. In some embodiments, the reflective wall 159 is omitted.

One of skill will recognize that the circular-shaped lens 105 can be any circularly symmetric shape about the center 120.

As discussed above, in some embodiments the antenna 100 includes a mounting plate 110. The mounting plate 110 includes a center 140 and a diameter 145. The mounting plate 110 is displaced a distance d2 from the first dielectric portion 142 at a position where the center 140 of the mounting plate 110 substantially aligns with the center 120 of the circular-shaped lens 105. The bolt 160 can also secure the mounting plate 110 to the cylindrical lens 105.

In some embodiments, the distance d2 is 1.56 cm. In some embodiments, the distance d2 is 1.32 cm. In some embodiments, the diameter 145 is 15 cm. In some embodiments, the mounting plate 110 functions as a ground plane for the antenna 100. In some embodiments, the mounting plate 110 is a conductive metal. In some embodiments, the mounting plate 110 is a non-conductive material. In some embodiments, the mounting plate is aluminum, brass, steel, or any other material suitable to support the cylindrical lens 105.

The plurality of feed elements 170 are positioned on the mounting plate 110 along an arc of a circle having a center substantially equal to the center 120 of the circular-shaped lens 105. In some embodiments, each of the feed elements is positioned 180 degrees from a corresponding feed element. In some embodiments, twenty four feed elements are used. In some embodiments, each of the plurality of feed elements 170 are connected to transmission lines. In some embodiments, each of the plurality of feed elements 170 are connected to coaxial connectors. In some embodiments, each of the plurality of feed elements 170 are positioned near the circumference of the circular-shaped lens 105. In some embodiments, the plurality of feed elements 170 are positioned within the volume of the circular-shaped lens 105.

In some embodiments, each of the plurality of feed elements 170 has a corresponding transmission line, 107*a*, 107*b*, 107*c*, 107*d*, 107*e*, 107*f*, 107*g*, 107*h*, 107*i*, . . . , 107*n*, generally 107. In some embodiments, each of the plurality of feed elements 170 are monocone antenna. FIG. 1C shows feed element 170*a* as a monocone antenna that is connected to transmission line 107*a* and feed element 170*f* as a monocone antenna that is connect to transmission line 107*f*. In some embodiments, the monocone antennas are brass. In some embodiments, the monocone antennas are 0.7 cm high and 1.3 cm wide.

Figure 2:
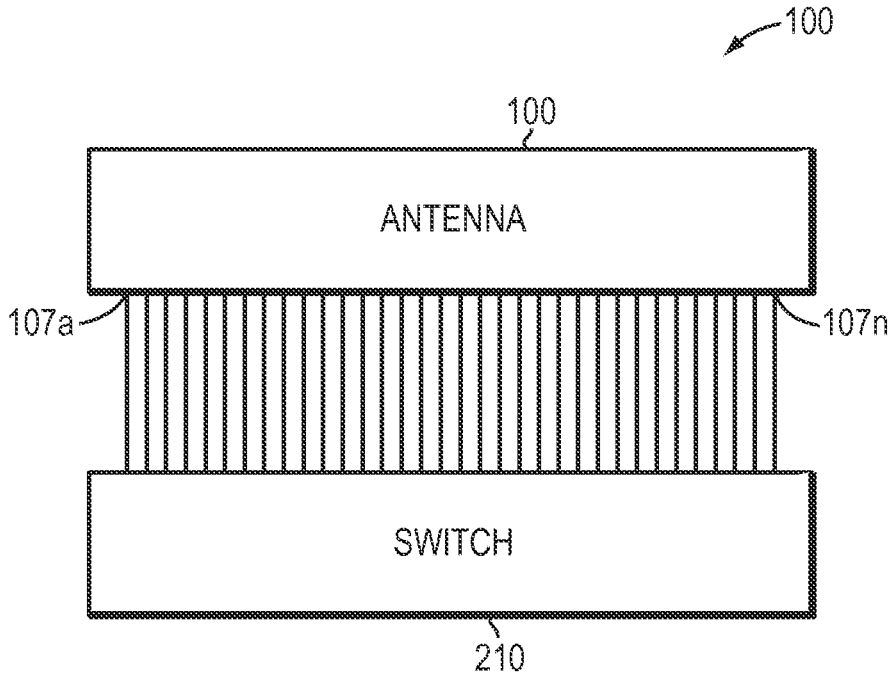
FIG. 2 is a diagram showing an antenna and a switching element, according to an illustrative embodiment of the invention.

FIG. 2 is a diagram 200 showing an antenna 100 including a switching element 210, according to an illustrative embodiment of the invention. As discussed above, the antenna 100 includes a plurality of feed elements 170. The plurality feed elements 170 are in electrical communication with the switching element 210. The switching element can allow the antenna 100 to transmit electromagnetic energy in a desired direction and/or receive electromagnetic energy from a desired direction. The switching element 210 selects one or more of the plurality of feed elements 170 to transmit electromagnetic energy based on the desired radiation direction. The switching element 210 selects one or more of the plurality of feed elements 170 to receive electromagnetic energy from a desired direction. In some embodiments, the switching element 210 is in communication with a computing device that controls the switching device to select the desired radiation direction.

In some embodiments, the antenna 100 provides full 360 degree coverage in azimuth with peak gain of 12 dBi at 10 GHz. In some embodiments, the antenna provides full 360 degree coverage in azimuth with peak gain of 18 dBi at 10 GHz. In some embodiments, the antenna 100 provides full 360 degree coverage in elevation. In some embodiments, the antenna 100 operates between 8.2-12.2 GHz. In some embodiments, each of the plurality of feed elements 170 is a monocone. In some embodiments, each of the plurality of feed elements 170 is a loop radiator. One of skill will appreciate that the plurality of feed elements 170 can be any type of element that is capable of transmitting or receiving electromagnetic energy.

During operation of the antenna 100 as a transmitter, one or more of the plurality of feed elements 170 receives power from a connected transmission line 107. Each of the plurality of feed elements 170 radiates electromagnetic energy into the lens. The circular-shaped lens 105 collimates at least a portion of the electromagnetic energy radiates a beam close to endfire at approximately 180 degrees away from the feed element location. During operation as a receiver, the circular-shaped lens 105 receives electromagnetic energy. The circular-shaped lens 105 focuses the received electromagnetic energy into the plurality of feed elements 170. The plurality of feed elements 170 further conveys the received electromagnetic energy to the transmission lines 107.

Figure 3:
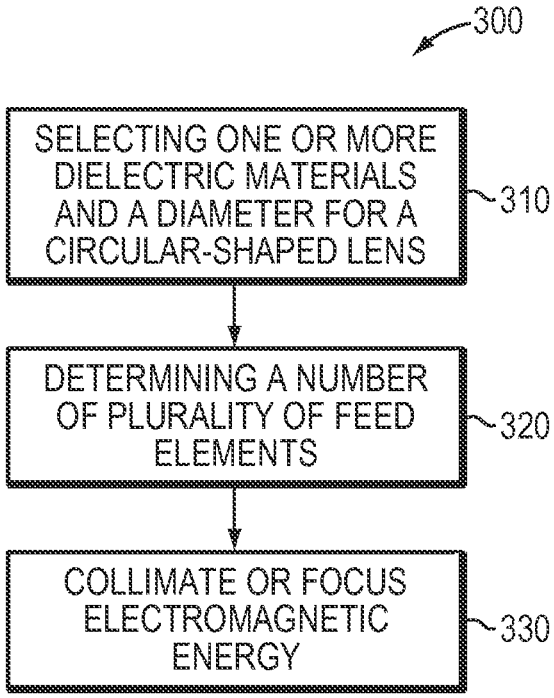
FIG. 3 is a flow diagram showing a method of transmitting and receiving electromagnetic waves, according to an illustrative embodiment of the invention.

FIG. 3 is a flow diagram 300 showing a method of transmitting and receiving electromagnetic waves, according to an illustrative embodiment of the invention.

The method includes selecting one or more dielectric materials and shapes, a diameter, and a thickness for a circular-shaped lens to achieve a low-profile lens with focal points close to the rim of the lens (Step 310). The dielectric material can be selected based on a desired behavior of a beam. For example, a dielectric material that allows electromagnetic energy entering a lens to collimate the electromagnetic energy into a beam that exits the lens at a 180 degrees from the electromagnetic entry point.

The method also includes determining a number of plurality of feed elements positioned near focal points adjacent to the circular-shaped lens along at least a portion of a circle that is substantially centered on the center of the circular-shaped lens. (Step 320). The number of plurality of feed elements can be determined based on the angular spacing of each feed element. The angular spacing of each feed element is typically equal to or less than one half-power beamwidth of the far field pattern of the lens, such that the crossover level between beams is at least −3 dB relative to the beam peaks. In some embodiments, the number of feed elements is based on the number of beams desired. In some embodiments, the number of feed elements is such that the feed elements are not in physical contact with each other.

The method also includes collimating or focusing electromagnetic energy transmitted or received by the circular-shaped lens based on at least one of the one or more dielectric materials, the diameter, and the number of plurality of feed elements. (Step 330). The collimation or focusing of electromagnetic energy can be determined by solving Maxwell's equations.

One skilled in the art can appreciate that the invention may be embodied in other specific forms without departing from the spirit or essential characteristics thereof. The foregoing embodiments are therefore to be considered in all respects illustrative rather than limiting of the invention described herein. Scope of the invention is thus indicated by the appended claims, rather than by the foregoing description, and all changes that come within the meaning and range of equivalency of the claims are therefore intended to be embraced therein.

The invention claimed is:

1. An antenna, comprising:

a circular-shaped lens disposed within a volume that has a first surface, a second surface, and a center, the circular-shaped lens having an axis of rotation that passes substantially through the first surface, the second surface and the center; and a plurality of feed elements positioned at a plurality of focal points of the circular-shaped lens along at least a portion of a circle that is centered substantially on the axis of rotation, wherein a thickness of the antenna is ⅓ or less of the diameter of the antenna.

2. The antenna of claim 1 wherein each feed element is positioned 180 degrees or substantially 180 degrees from a corresponding feed element of the plurality of feed elements.

3. The antenna of claim 1 wherein one or more of the plurality of feed elements transmits electromagnetic energy to the circular-shaped lens and the circular-shaped lens collimates at least a portion of the transmitted electromagnetic energy.

4. The antenna of claim 3 further comprising a switching element in electrical communication with the plurality of feeds, the switching element selects the one or more of the plurality of feed elements to transmit electromagnetic energy such that the transmitted electromagnetic energy has a maximum radiation in a desired direction.

5. The antenna of claim 3 further comprising a switching element in electrical communication with the plurality of feeds, the switching element selects the one or more of the plurality of feed elements to receive electromagnetic energy from a desired direction.

6. The antenna of claim 1 wherein the circular-shaped lens receives electromagnetic energy and focuses at least a portion of the received electromagnetic energy to one or more of the plurality of feed elements.

7. The antenna of claim 1 wherein one or more of the plurality of feed elements is in electrical communication with one or more transmission lines.

8. The antenna of claim 1 wherein the plurality of feed elements are monocone antennas.

9. The antenna of claim 8 wherein the monocone antennas are in electrical communication with transmission lines.

10. The antenna of claim 1 wherein the antenna transmits and receives electromagnetic waves having a frequency between 8.2 to 12.2 gigahertz.

11. The antenna of claim 1 wherein at least a portion of the circular-shaped lens is a dielectric material.

12. A method of transmitting and receiving electromagnetic energy, the method comprising:

selecting one or more dielectric materials and a diameter and thickness for a circular-shaped lens having a center;

determining a number of plurality of feed elements positioned adjacent to the circular-shaped lens along at least a portion of a circle that is substantially centered on the center of the circular-shaped lens; and collimating or focusing electromagnetic energy transmitted or received by the circular-shaped lens based on at least one of the one or more dielectric materials, the diameter, and the number of plurality of feed elements.

13. The method of claim 12 further comprising positioning each feed element 180 degrees or substantially 180 degrees from a corresponding feed element of the plurality of feed elements.

14. The method of claim 12 further comprising:

transmitting, by one or more of the plurality of feed elements, electromagnetic energy to the circular-shaped lens; and collimating, by the circular-shaped lens, at least a portion of the transmitted electromagnetic energy to radiate in a desired direction.

15. The method of claim 12 wherein focusing electromagnetic waves received by the circular-shaped lens further comprises focusing the electromagnetic waves to one or more of the plurality of feed elements.

16. The method of claim 12 wherein one or more of the plurality of feed elements are in electrical communication with one or more transmission lines.

17. The method of claim 12 further comprising selecting the one or more of the plurality of feed elements to transmit electromagnetic energy such that the collimated portion of the transmitted electromagnetic signals has a maximum radiation in a desired direction.

18. The method of claim 12 further comprising selecting the one or more of the plurality of feed elements to receive electromagnetic energy such that the collimated portion of the received electromagnetic energy has a maximum reception from a desired direction.

19. The method of claim 17 wherein the plurality of feed elements are monocone antennas.

20. The method of claim 19 wherein the monocone antennas are in electrical communication with transmission lines.

* * * * *